US005564892A

United States Patent [19]

Holbert

[11] Patent Number: 5,564,892

[45] Date of Patent: Oct. 15, 1996

[54] VENEER STACKER

[76] Inventor: John C. Holbert, 5815 SW. West Hills Rd., Corvallis, Oreg. 97330

[21] Appl. No.: 499,180

[22] Filed: Jul. 7, 1995

[51] Int. Cl.[6] ..... B65H 29/32; B65G 57/04

[52] U.S. Cl. ..... 414/793.1; 198/415; 198/688.1; 209/905

[58] Field of Search ..... 414/793, 793.1; 198/415, 688.1, 689.1; 209/651, 653, 905; 271/227, 228, 197, 198, 276

[56] References Cited

U.S. PATENT DOCUMENTS

| | | | |
|---|---|---|---|
| 1,873,316 | 12/1928 | Droitcour | 271/197 |
| 3,227,275 | 1/1966 | Cody | 414/793.1 |
| 3,328,027 | 6/1967 | Schmidtke | 271/197 |
| 3,395,915 | 8/1968 | Clausen et al. | 414/793.1 |
| 3,583,562 | 6/1971 | Yock | 209/905 |
| 3,907,127 | 9/1975 | Bollinger et al. | 414/793.1 |
| 4,256,214 | 3/1981 | Back, Jr. | 414/793.1 |
| 4,500,243 | 2/1985 | Ward, Jr. et al. | 414/793.1 |
| 4,901,842 | 2/1990 | Lemboke et al. | 198/688.1 |
| 4,905,843 | 3/1990 | Holbert . | |
| 5,078,384 | 1/1992 | Moore | 271/228 |
| 5,141,112 | 8/1992 | Holbert . | |
| 5,169,140 | 12/1992 | Wenthe, Jr. | 271/228 |

FOREIGN PATENT DOCUMENTS

| | | | |
|---|---|---|---|
| 1119167 | 12/1961 | Germany | 414/793.1 |
| 2113239 | 9/1971 | Germany | 271/197 |

*Primary Examiner*—Karen B. Merritt
*Assistant Examiner*—Douglas Hess
*Attorney, Agent, or Firm*—Robert L. Harrington

[57] ABSTRACT

A veneer stacker with a controlled overhead conveyor to maintain the leading edge of successive veneer sheets in a common orientation and normal to the travel direction of the conveyor. The overhead conveyor has paired members, e.g., conveyor belts that engage the side edges of the veneer sheet to propel the sheet. One member of each pair is arranged to dominate and the dominant members cooperatively control the movement of the sheet. The sheets are assured of a normal orientation using separate drive motors for each dominant member and electronically coupling the drive motors.

6 Claims, 7 Drawing Sheets

VENEER STACKER

U.S. Pat. No. 5,141,112, Holbert issued Aug. 25, 1992 and U.S. Pat. No. 4,905,843, Holbert issued Mar. 6, 1990 are herein incorporated by reference.

FIELD OF THE INVENTION

This invention relates to veneer stackers and more particularly an improved veneer stacker that has apparatus for maintaining a veneer sheet in a set attitude as it is being conveyed.

BACKGROUND INFORMATION

Logs are peeled to produce a thin continuous strip of veneer. The veneer is very thin, being on the order of 0.1 inches thick. The continuous ribbon of veneer is clipped into designated sizes to form veneer sheets. Typically the veneer is clipped into half sheet or full sheet sizes. The veneer sheets will subsequently be laminated together to form plywood.

The veneer sheets are graded according to size, quality and moisture content and are uniformly stacked for subsequent processing. Typically the veneer sheets are stacked as they come off the clipper, are unstacked for drying and are graded again after the drying cycle and restacked in individual stacks.

A veneer stacker that performs the stacking operation, whether it be green undried veneer sheets or the dried veneer sheets is of the type as disclosed in U.S. Pat. No. 4,905,843. The stacker of the '843 patent is arranged to receive veneer sheets from an infeed conveyor and accurately align each veneer sheet on its overhead conveyor. Alignment during conveyance is important for achieving alignment in the stacks where sheets that are misaligned are subject to damage.

The overhead conveyor has two pair of belts that traverse a plenum. The pairs are spaced apart to engage the veneer sheet near its side edges to transport the sheets along the length of the conveyor. The veneer stacker relies on differential air pressure to adhere the veneer sheets to the belts of the overhead conveyor. Apertures in the plenum are provided between the belts of each belt pair and when air is withdrawn from the plenum, the differential air pressure will draw the sheet toward the plenum and into frictional engagement with the belts. The stacker of the '843 patent has a controlled adjusting mechanism that will accurately adjust the position of the veneer sheet, if required, on the overhead conveyor of the stacker so that the leading edge of the veneer sheet is normal to the travel direction of the overhead conveyor. Knock off shoes are provided to accurately discharge the veneer sheets into selected bins or compartments according to size, quality, moisture content and so forth.

One of the problems is that the veneer sheets may become discriminately skewed on the overhead conveyor as it is transported along the length of the overhead conveyor even though the veneer sheets are initially accurately aligned by the adjusting mechanism. This is due in part to normal wear creating variances between the drive mechanism and the belts, i.e., the belts of a pair of belts are driven at slightly different speeds, and because of variances in the surface of the veneer sheets providing different frictional gripping properties in areas of engagement by the belts.

The drive mechanisms that drive the belts are matched and the belts are matched for uniformity of height (thickness), width and length and are selected to have the same coefficient of friction. Normal wear however causes a variance in the belts. One belt of a pair of belts may wear more rapidly than the other causing a variance in thickness.

As a belt wears it may become thinner (decrease in thickness) than the other belt. The thinner belt as it is propelled by the drive mechanism will have a slightly different velocity than a thicker belt. As a belt traverses a drive mechanism such as a circular drive wheel it is subject to a compressive and stretching action about a plane that is near the center of the belts thickness. The material of the belt nearest the drive wheel and below the plane is compressed and the material furthest from the drive wheel and above the plane is stretched. The plane about which the belt is compressed/stretched depends on the thickness of the belt. The plane in effect determines the velocity at which the belt will traverse the drive wheel. Thus a belt that is worn thin will have a different velocity than a thicker belt and any variance in the wear rate as between the belts will affect the belt velocity even though the drive wheels are driven at the same rate of rotation.

The surface of a veneer sheet can vary as between smoothness and roughness and a belt gripping the rougher surface will dominate. As between each belt in the pair of belts, one sheet may have a greater adherence to one of the belts of the pair and a second sheet will have a greater adherence to the other of the belts. The difference in velocity of the belts will accordingly cause a slight skewing of the veneer sheets as the sheets are propelled by the overhead conveyor and the skewing will be different from sheet to sheet. The sheets deposited in the stack accordingly become misaligned.

BRIEF SUMMARY OF THE INVENTION

The present invention is an improved veneer stacker that maintains the veneer sheet in the desired attitude on the upper conveyor throughout the conveyance to accurately deposit the veneer sheets on a selected stack.

A preferred embodiment of the present invention has two pairs of belts on the overhead conveyor for transporting a veneer sheet along the length of the machine. One belt of each pair has a substantially greater coefficient of friction than the other such that the belt with the higher coefficient of friction always dominates and controls the propelling of the respective sides of the veneer sheet regardless of the roughness or smoothness of the sheet surface. The variance between the belts of a belt pair no longer causes a variance in the rate of propulsion.

In another embodiment, a single belt and a low friction slide rail are provided in pairs to transport the veneer sheet along the length of the machine. A single belt on each side of the veneer sheet respectively controls the sides of the veneer sheet and the sheet simply slides along the low friction slide rail, again without regard to the roughness/smoothness variation in sheet surface.

The above addresses the problem of relative skewing as between successive sheets caused by the different speeds of the belts in a pair of belts. Skewing of the sheets resulting from a speed differential as between the pair of belts is also undesirable and is resolved by providing a master drive for one pair of belts and a slave drive for the other pair. The drive shaft that propels the belts, whether it be a pair of belts or a belt and a low friction slide rail, is split. The belt (or belts) on one side are driven by the master drive and the belt (or belts) on the other side are driven by the slave drive which is, e.g., electronically matched to the master drive.

DESCRIPTION OF THE PREFERRED EMBODIMENT

Figure 1:
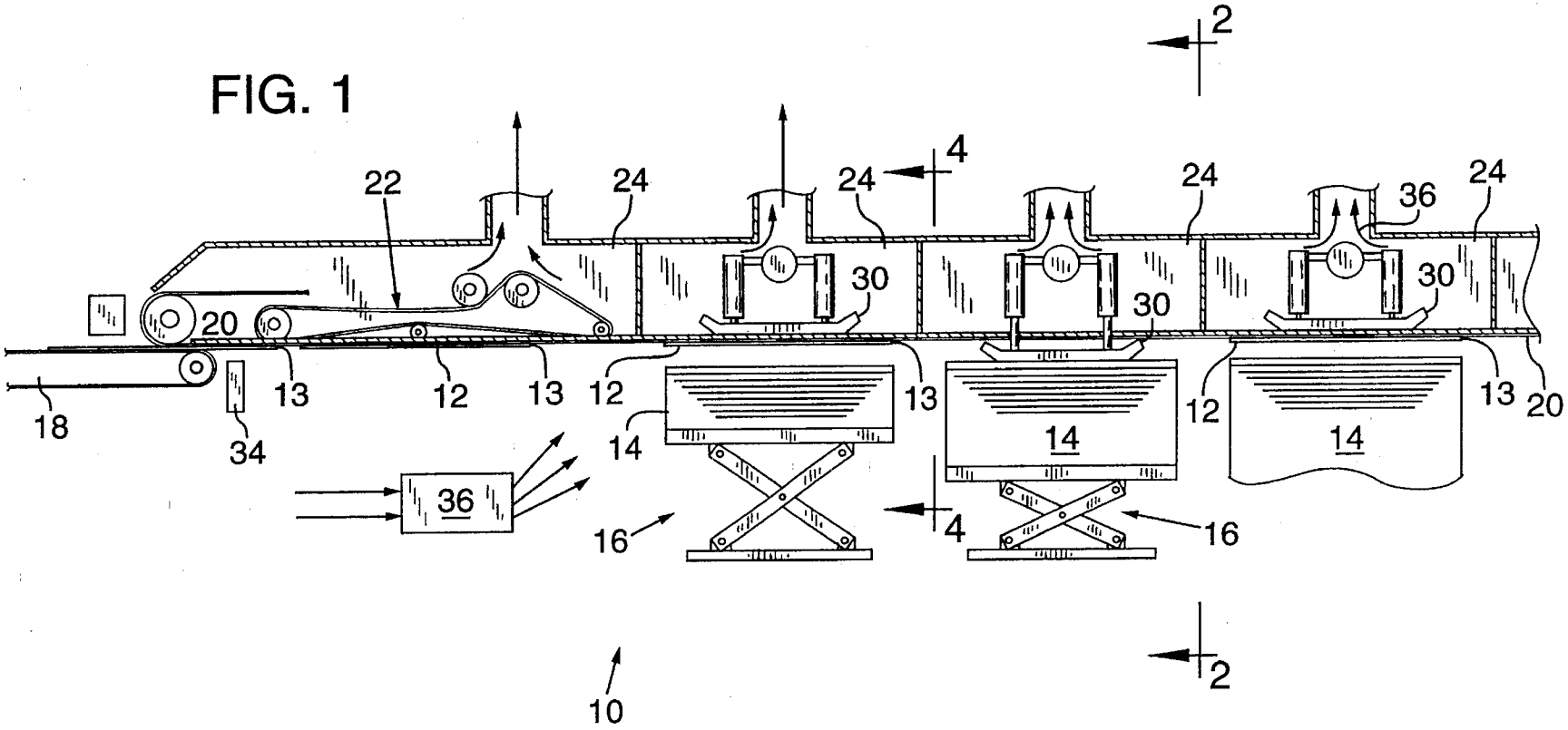
FIG. 1 is a schematic view of a veneer stacker of the present invention.

Refer now to FIG. 1 which schematically illustrates a veneer stacker 10 of the present invention. The stacker 10 is arranged to deposit veneer sheets 12 into determined stacks 14 according to moisture content, size and grade of the veneer sheets 12. The stacker has multiple bins or compartments into which the sheets will be deposited. The compartments are simply indicated by leveling apparatus 16 and as shown the sheets 12 are deposited in stacks 14 on the leveling apparatus 16.

An infeed conveyor 18 conveys sheets 12 in sequence to the stacker 10 and the sheets 12 are transferred from the infeed conveyor 18 to an overhead conveyor 20 of the stacker 10. Detectors 34 are positioned in the travel path of the sheet 12 to detect the corners of the leading edge 13 of the sheet 12 to determine whether or not the leading edge 13 of the sheet 12 is skewed relative to the travel direction of the overhead conveyor 20. The overhead conveyor 20 has a position adjusting mechanism 22 that will, if required, re-align the leading edge 13 of the sheets 12 normal to the travel direction of the conveyor 20.

The overhead conveyor 20 relies on differential air pressure to adhere the veneer sheets 12 to the conveyance mechanism of the overhead conveyor 20. The conveyance mechanism will later be described and illustrated. The stacker 10 has multiple plenums 24 from which air is withdrawn to create a differential air pressure. Openings (apertures) 26 (best seen in FIG. 3) are provided on the underside of the plenums 24 for air to flow into the plenums 24. The apertures 26 are provided along the length of the multiple plenums 24 and a member of the conveyance mechanism is positioned adjacent the apertures 26 with one member on one side of the apertures and another member on the opposite side of the apertures 26. The sheets 12 as they are transferred to the conveyance mechanism will be forced to adhere to the conveyance mechanism by the differential air pressure.

Knock off shoes 30 are provided for each of the compartments and are arranged to uniformly and accurately discharge the veneer sheets 12 from the overhead conveyor 20 into a designated compartment.

A computer 36 controls the operation of the stacker 10. The computer 36 will, if required, control the operation of the adjusting mechanism 22 to adjust the position of the sheet 12 on the overhead conveyor 20; will control the operation of the knock off shoes 30 to accurately and uniformly deposit the sheets 12 into stacks 14 in determined compartments 16 and will control the operation of the upper conveyor 20.

The position adjusting mechanism 22 of the stacker 10 is arranged to accurately position the veneer sheets 12 on the overhead conveyor 20 with the leading edge 13 of the sheet 12 aligned normal to the travel direction of the conveyor 20. The travel direction of the overhead conveyor 20 is indicated by arrow 28.

Figure 2:
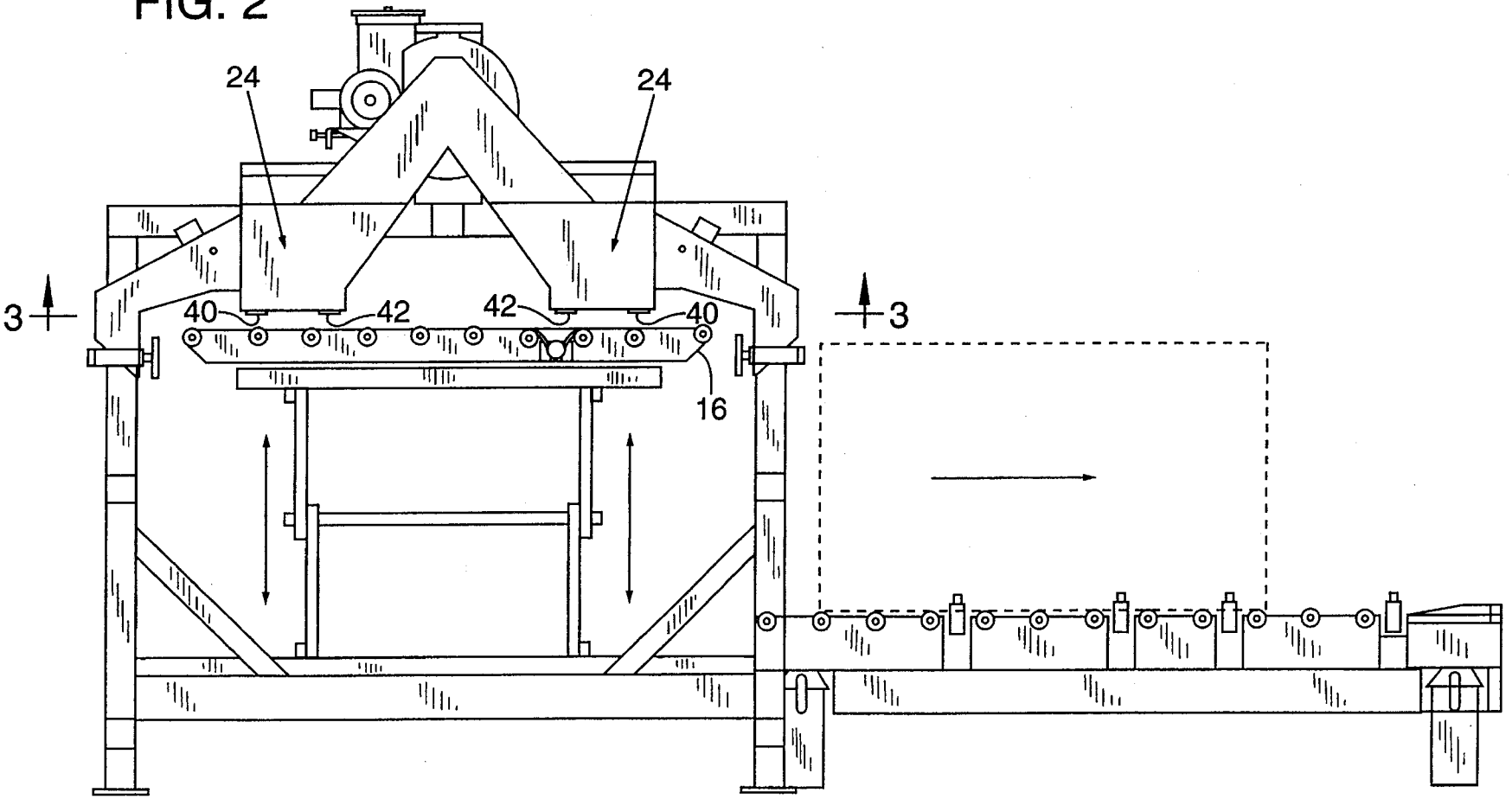
FIG. 2 is a view of the veneer stacker of FIG. 1 as viewed on view lines 2—2 of FIG. 1.
Figure 3:
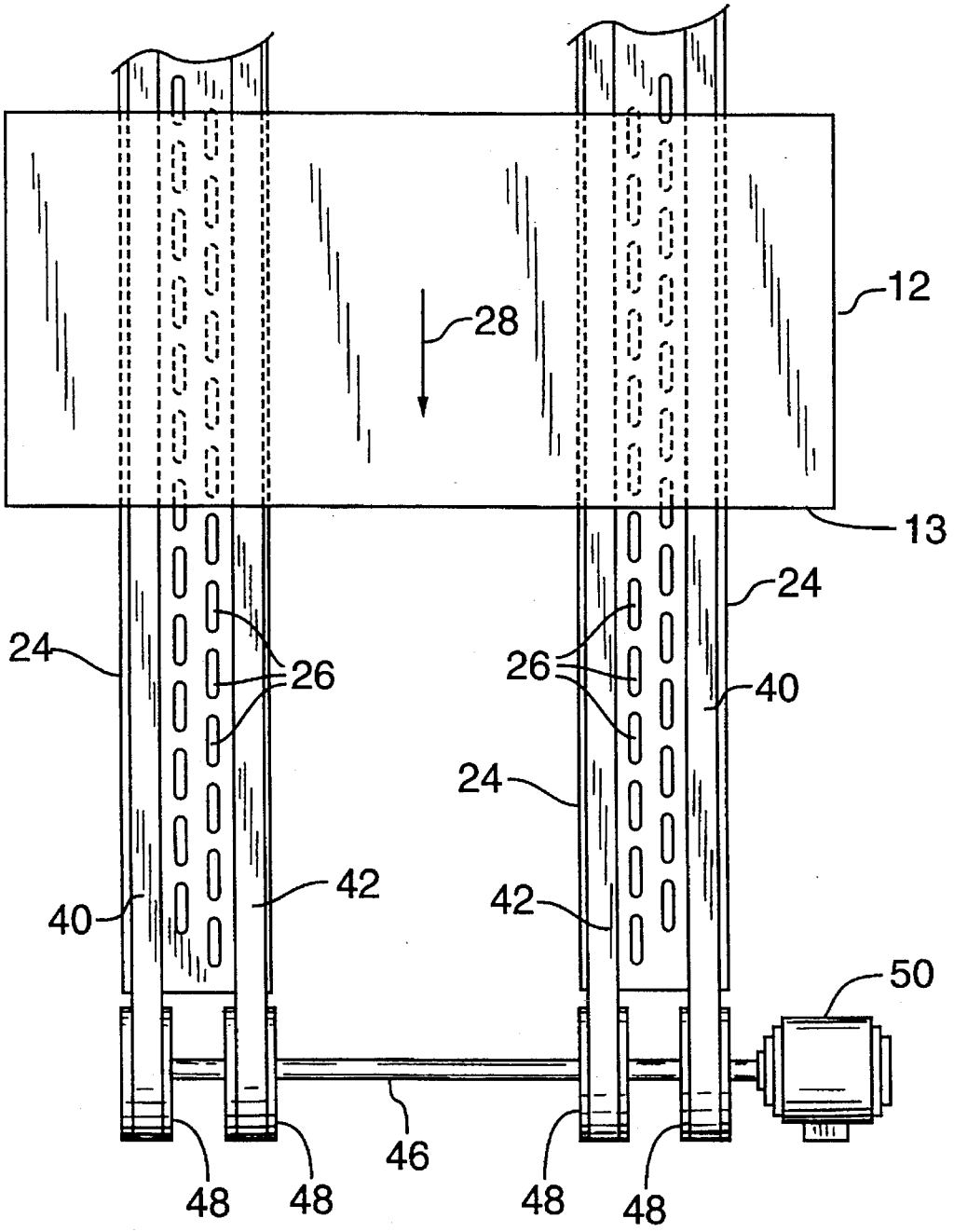
FIG. 3 is a view as viewed on view lines 3—3 of FIG. 2.
Figure 4:
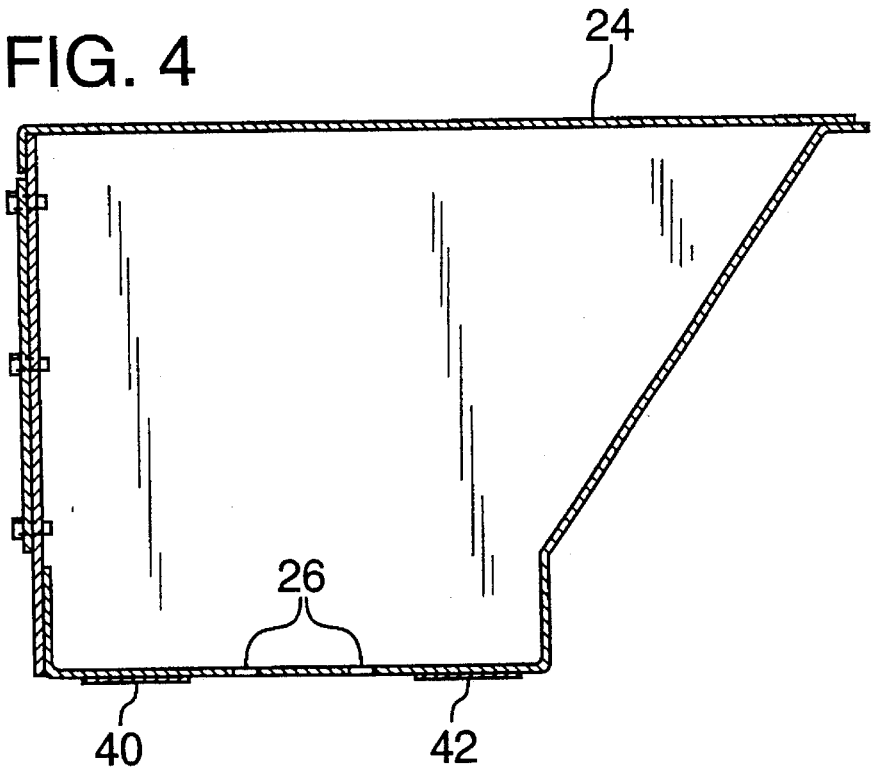
FIG. 4 is a view as viewed on view lines 4—4 of FIG. 1 but illustrating one side only of the conveyor and plenum.

Referring to FIGS. 2, 3 and 4 of the drawings the overhead conveyor 20 in one embodiment utilizes two pairs of belts which may be referred to as spaced apart conveyor tracks as the conveyance mechanism. As shown, the belts are entrained along the plenums 24 with the belts traveling, in part, on the underside of the plenum (see FIG. 4) to engage sheets 12 to be transported. Apertures 26 are provided in the plenums 24 between the belts of a belt pair. One belt 40 travels on one side of the apertures 26 and the other belt 42 travels along the other side of the apertures 26. When air is withdrawn from the plenums 24, air flows through the apertures 26, and the sheets 12 will be, due to the differential air pressure, be forced into contact with the paired belts 40, 42. As shown one belt pair 40, 42 will engage the sheet near one side edge and the other belt pair 40, 42 will engage the sheet near the other side edge.

One belt 40 of the belt pair is selected to have a higher coefficient of friction than the other belt 42 of the belt pair. The belt 40, having the higher coefficient of friction, will dominate to control the rate of travel of that side of the sheet 12 regardless of the rate of travel of the belt 42. The successive veneer sheets 12 will thus be propelled in a consistent attitude by the belts 40, each belt 40 engaging the sheet 12 near opposite side edges. This eliminates the possibility of the sheets becoming relatively skewed on the conveyor 20 due to the variance of belt 40 propelling one sheet 12 under one condition and the belt 42 propelling a successive sheet 12 under other conditions.

Figure 5:
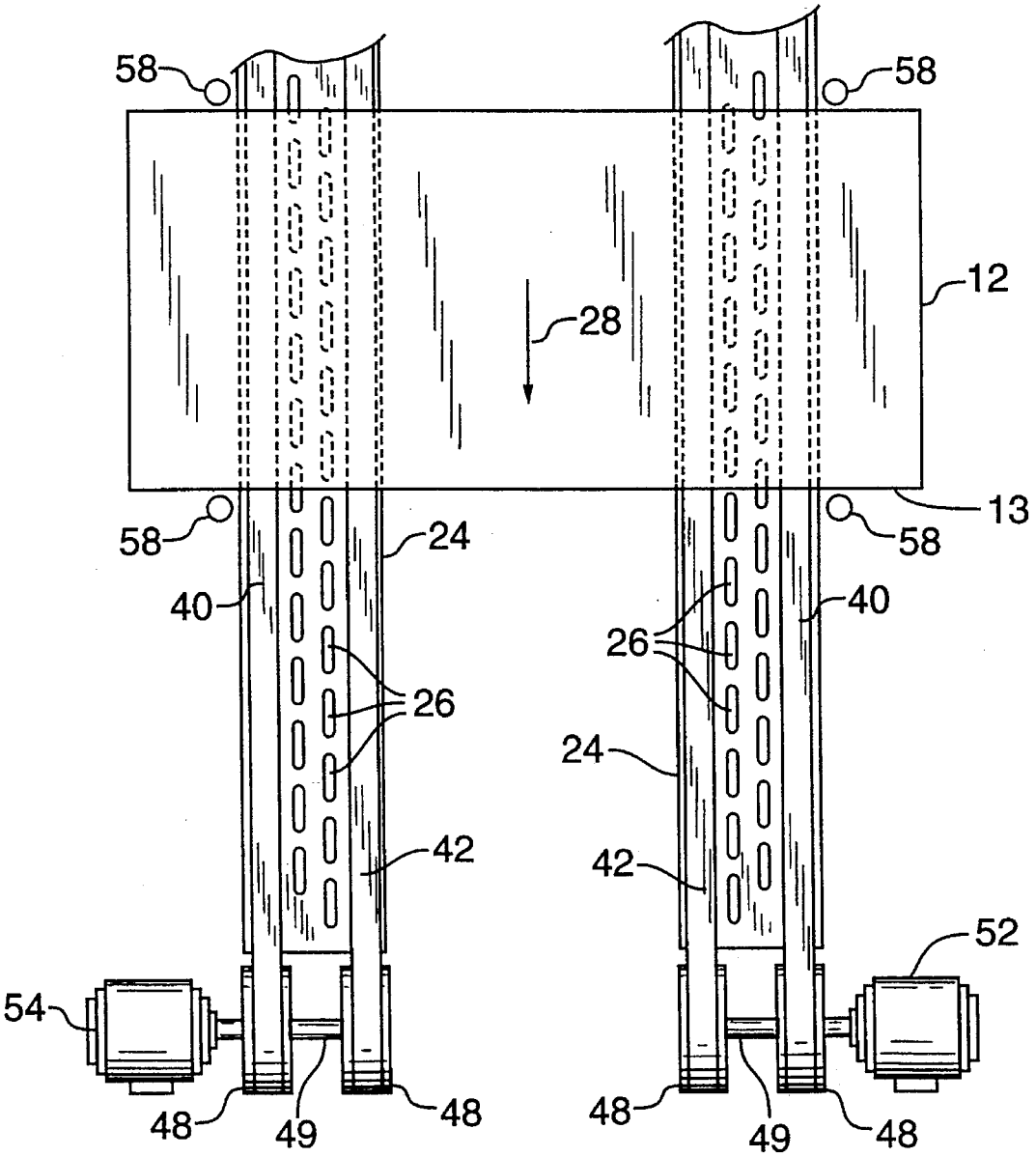
FIG. 5 is a view similar to FIG. 3 illustrating an embodiment including individual drive mechanisms for the belt pairs.

As shown in FIG. 3, both pair of drive belts 40, 42 are driven by drive pulleys 48 mounted to a common drive shaft 46 which is coupled to a single source drive such as a motor 50. An alternative arrangement for the drive is illustrated in FIG. 5. Each of the paired drive belts 40, 42 has its own drive shaft pulleys 48 and drive shaft 49 coupled to their own drive mechanism. The pair of drive belts 40, 42 on one side of the plenum (on the left side as viewed in the figure) has a drive motor 52 and the other pair of drive belts 40, 42 has a separate drive motor 54. In this embodiment the drive motor 54 is the master drive and the slave drive motor 52 is electronically coupled to the master drive motor 54. Sensors determine the relative speed of the dominant drive belts and the slave drive motor 52 is controlled to insure that the dominant belt driven by motor 52 is precisely the same speed as the dominant belt driven by the master drive motor 52. Various types of sensors determining the precise belt speeds are available and indicated schematically at reference 58 in FIG. 5.

Figure 8:
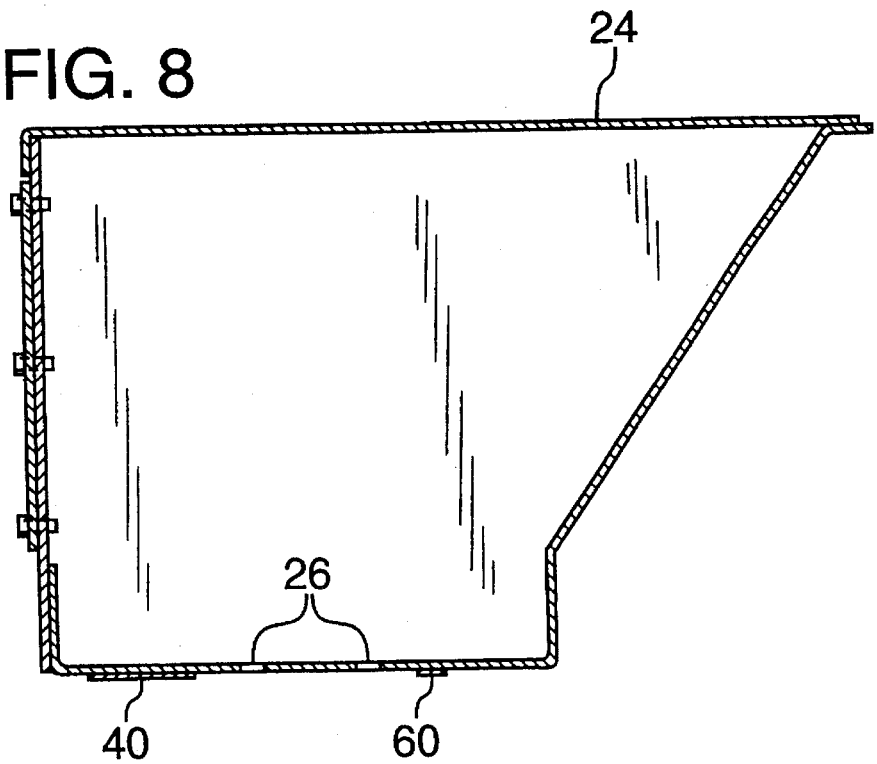
FIG. 8 is a view similar to FIG. 4 illustrating the embodiment of FIG. 6.
Figure 6:
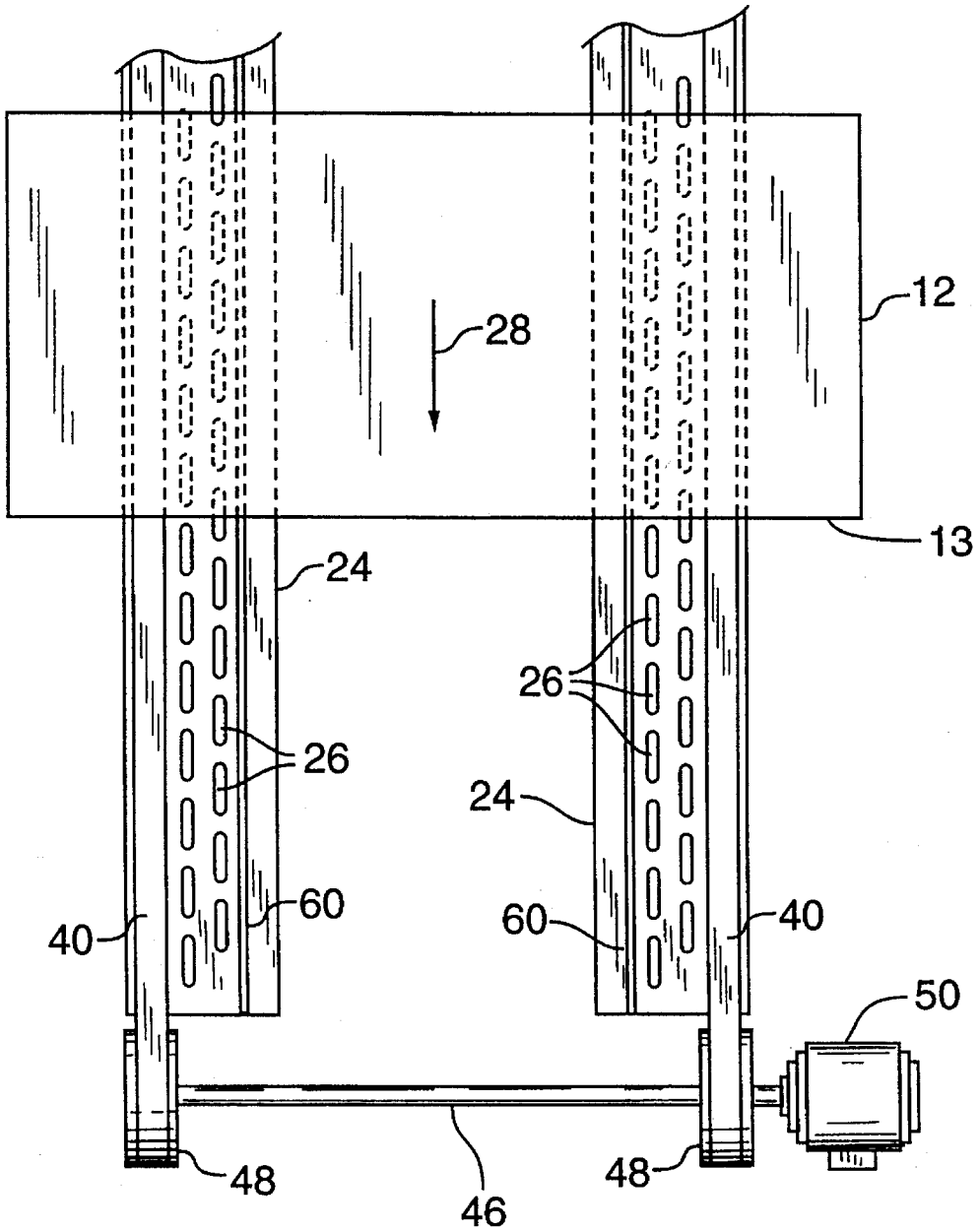
FIG. 6 is a view similar to FIG. 3 illustrating an alternative embodiment to the invention of FIGS. 1–4.
Figure 7:
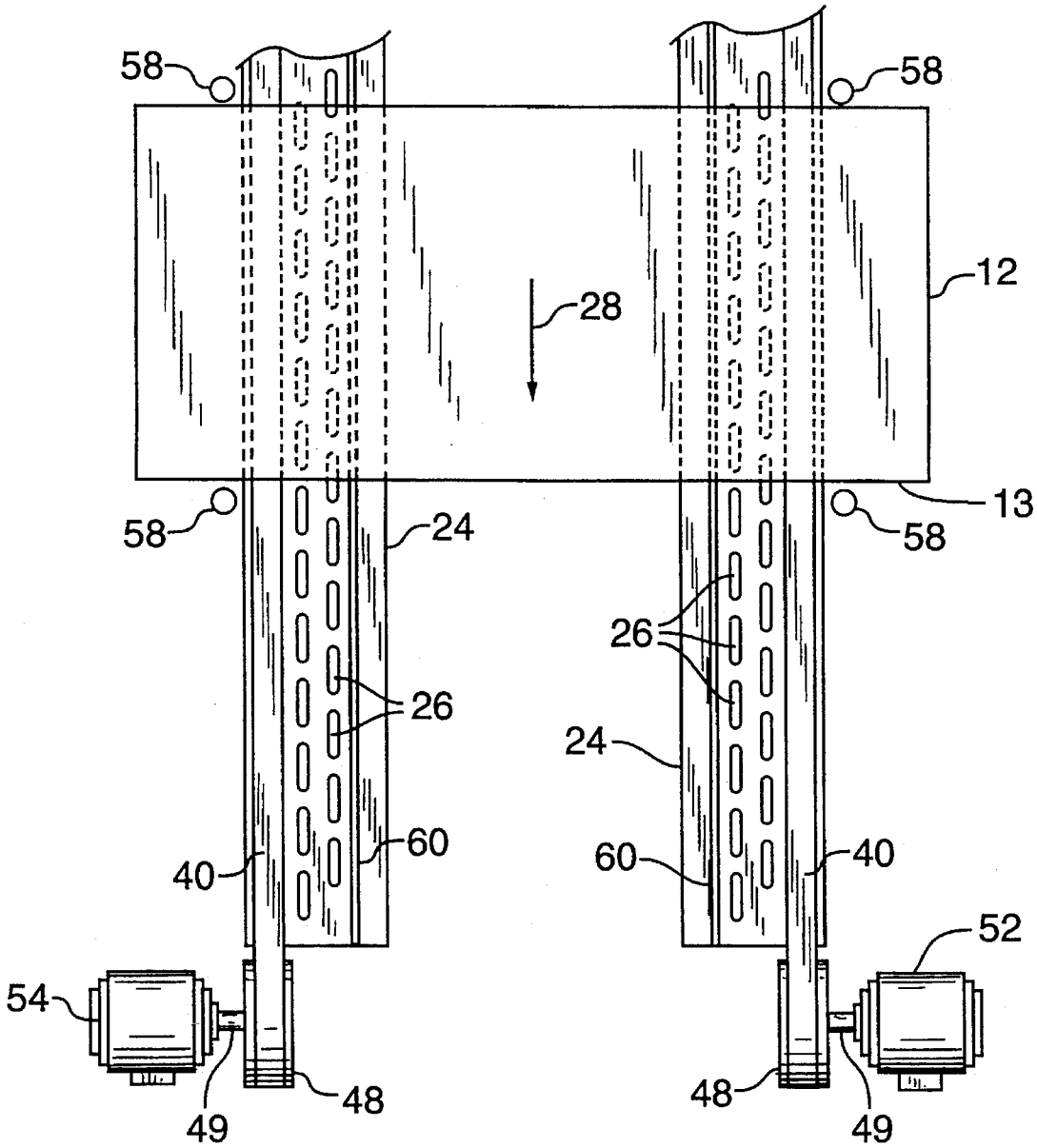
FIG. 7 is a view similar to FIG. 6 illustrating individual drive mechanisms.

FIGS. 6, 7 and 8 illustrate another embodiment of the upper conveyor 20. In this embodiment the belts 42 are replaced with low friction slide rails 60. The slide rails 60 on each side of the upper conveyor are positioned adjacent the apertures 26 along the length of the multiple plenums 24. Belts 40 are positioned to travel along the opposite side of the apertures. The belts 40 are propelled by pulleys 48 mounted to a common drive shaft 46 which is coupled to a drive motor 50. The belts 40 will control the movement of the sheet 12 with one belt engaging the sheet 12 near one side edge and the other belt engaging the sheet near the opposite side edge. The sheet 12 will simply slide along the low friction slide rails 60 as the sheet 12 is transported along the upper conveyor 20 by the belts 40.

FIG. 7 illustrates a belt 40 and rail 60 pair arrangement wherein one of the belts 40 is driven by a master drive motor 54 and the other belt 40 is driven by a drive motor 52 that is electronically coupled to the master drive motor 54. Sensors 58 are provided on each side of the conveyor 20 along the length of the conveyor 20 to sense the belt speeds and maintain the same speed as described in connection with FIG. 5.

Those skilled in the art will recognize that modifications and variations may be made without departing from the true spirit and scope of the invention. The invention is therefore not to be limited to the embodiments described and illustrated but is to be determined from the appended claims.

What is claimed is:

1. A veneer stacker comprising:

an overhead conveyor including a pair of spaced apart conveyor tracks arranged for engagement by opposed sides of a veneer sheet and for conveying successive veneer sheets along a path for selective deposit in multiple stacks underlying the path, each of said tracks including a pair of spaced apart bearing members and apparatus associated with the conveyor for urging air flow upwardly between the bearing members and thereby urging the successive veneer sheets into engagement with the bearing members;

at least one of said bearing members of each of said conveyor tracks being a driven conveyor belt, said one of said bearing members of each track having gripping engagement with said veneer sheets that substantially exceeds the gripping engagement by the other of said members whereby the cooperative engagement by said one of said bearing members of said tracks dictates the conveyance of said veneer sheets.

2. A veneer stacker as defined in claim 1, wherein:

the other of said bearing members are belts which are movably driven;

said one of said bearing members having a higher coefficient of friction than that of the other of said bearing members for gripping and controlling movement of the veneer sheets.

3. A veneer stacker as defined in claim 2, wherein:

both pairs of driven belts are driven by a common drive mechanism.

4. A veneer stacker as defined in claim 3, wherein:

a plenum overlies the conveyors;

two sets of apertures are formed in the underside of and extending the length of the plenum, one set of apertures spaced at a distance from the other set and a set each provided between the belts of each belt pair whereby air drawn into the plenum is drawn through the apertures and between the members.

5. A veneer stacker as defined in claim 1, wherein:

the other member of each pair of bearing members is a low friction slide rail.

6. A veneer stacker as defined in claim 1, wherein:

said one of said bearing members of one of said tracks being driven by a master drive mechanism and one of said bearing members of the other track being driven by a slave drive mechanism that is electronically coupled to the master drive mechanism to insure that said one of said bearing members of each track is driven at the same speed.

* * * * *